United States Patent [19]

Pleasants

[11] Patent Number: 4,986,362

[45] Date of Patent: Jan. 22, 1991

[54] RUNNING TOOL FOR USE WITH REELED TUBING AND METHOD OF OPERATING SAME

[76] Inventor: Charles W. Pleasants, 4008 Windy Crest Dr., Carrollton, Tex. 75007

[21] Appl. No.: 417,282

[22] Filed: Dec. 8, 1989

[51] Int. Cl.[5] ..... E21B 23/02

[52] U.S. Cl. ..... 166/382; 166/125

[58] Field of Search ..... 166/382, 385, 125, 212, 166/181

[56] References Cited

U.S. PATENT DOCUMENTS

| | | | |
|---|---|---|---|
| 1,927,836 | 9/1933 | Kightlinger . | |
| 2,499,695 | 3/1950 | Storm . | |
| 2,828,822 | 1/1955 | Greer . | |
| 2,851,110 | 9/1958 | Greer . | |
| 3,051,239 | 8/1962 | Dollison . | |
| 3,051,243 | 8/1962 | Grimmer et al. . | |
| 3,088,533 | 5/1963 | Sutliff . | |
| 3,208,531 | 9/1965 | Tamplen . | |
| 3,393,002 | 7/1968 | Woolley . | |
| 3,405,773 | 10/1968 | Sutliff et al. . | |
| 3,944,273 | 3/1976 | Ahlstone . | |
| 3,946,819 | 3/1976 | Hipp . | |
| 3,949,821 | 4/1976 | Raugust . | |
| 4,093,294 | 6/1978 | Taylor . | |
| 4,161,224 | 7/1979 | Hostrup . | |
| 4,179,002 | 12/1979 | Young . | |
| 4,181,186 | 1/1980 | Blanton . | |
| 4,185,865 | 1/1980 | Taylor . | |
| 4,186,807 | 2/1980 | Sutliff et al. . | |
| 4,346,770 | 8/1982 | Beck . | |
| 4,396,061 | 8/1983 | Tamplen et al. . | |
| 4,436,150 | 3/1984 | Barker . | |
| 4,515,220 | 5/1985 | Sizer et al. . | |
| 4,558,895 | 12/1985 | Tamplen . | |
| 4,612,984 | 9/1986 | Crawford | 166/77 |
| 4,625,799 | 12/1986 | McCormick et al. . | |
| 4,646,830 | 3/1987 | Templeton . | |
| 4,682,657 | 7/1987 | Crawford . | |
| 4,685,516 | 8/1987 | Smith et al. . | |
| 4,708,208 | 11/1987 | Halbardier . | |
| 4,715,445 | 12/1987 | Smith, Jr. . | |
| 4,759,406 | 7/1988 | Smith et al. . | |
| 4,767,145 | 8/1988 | Bullard . | |
| 4,793,417 | 12/1988 | Rumbaugh . | |
| 4,796,707 | 1/1989 | Halbardier . | |
| 4,805,699 | 2/1989 | Halbardier . | |
| 4,844,166 | 7/1989 | Going, III et al. | 166/379 |
| 4,862,958 | 9/1989 | Pringle | 166/72 |
| 4,869,325 | 9/1989 | Halbardier . | |

FOREIGN PATENT DOCUMENTS

| | | |
|---|---|---|
| 8400577 | 2/1984 | PCT Int'l Appl. . |
| 2089400 | 11/1981 | United Kingdom . |

*Primary Examiner*—William P. Neuder

*Attorney, Agent, or Firm*—Warren B. Kice

[57] ABSTRACT

A running tool for use with reeled tubing and a method of operating same in which a piston assembly extending over a portion of an inner mandrel assembly and in engagement with a locking device. Shear pins connect the piston assembly relative to the inner mandrel assembly and a fluid chamber is defined by cooperating shoulders formed on the inner mandrel assembly and the piston assembly. The inner mandrel assembly has a bore which can be connected to the fluid chamber for establishing fluid pressure in the fluid chamber to exert oppositely directed forces on the shoulder to shear the shear pins in response to a predetermined value of the fluid pressure to permit axial movement of the piston assembly to actuate the locking device.

22 Claims, 5 Drawing Sheets

RUNNING TOOL FOR USE WITH REELED TUBING AND METHOD OF OPERATING SAME

BACKGROUND OF THE INVENTION

This invention relates to a running tool and method of operating same and more particularly to such a tool and method which can be used with reeled tubing in a downhole well environment.

Downhole well operating tools are often used in completed wells for performing several functions such as controlling or preventing the flow of fluid through the wellbore. Typically these tools are connected to a locking mandrel for locking them in place relative to a landing nipple, or the like, disposed in the wellbore, and the locking mandrel is connected to and actuated by a running tool. The running tool, with the locking mandrel and operating tool attached, is lowered into the wellbore until the locking mandrel locates and is locked in the landing nipple.

However, these type of arrangements are complicated due to the various moving parts and separate functions required to set the locking mandrel relative to the nipple, lock same and then secure same. Also, they often require jarring action to actuate the locking mandrel which itself is complicated and causes wear on the components.

This complexity would be compounded in connection with the use of coiled, or reeled, tubing which enables fluids such as water, nitrogen, diesel fuel, corrosion inhibitor, foam acid, etc. to be introduced into the wellbore, as disclosed for example in U.S. Pat. No. 4,793,417. In these situations, it would be extremely difficult, if not impossible, to operate the locking mandrel by corresponding movement of the reeled tubing due to the added weight and decreased maneuverability of the reeled tubing. Also, the wellbore fluid acting on the outer surface of the reeled tubing tends to collapse and disable the tubing.

SUMMARY OF THE INVENTION

It is therefore an object of the present invention to provide a running tool and method of the above type in which the tool is connected to a locking mandrel carrying an operating tool and is adapted to actuate the locking mandrel.

It is a further object of the present invention to provide a running tool and method of the above type which can be utilized with reeled tubing and can be inserted into a horizontal or deviated wellbore.

It is a still further object of the present invention to provide a running tool and method of the above type which has a minimal number of moving parts which can be actuated in a positive and efficient manner by fluid pressure.

It is a still further object of the present invention to provide a running tool and method of the above type which prevents collapsing of the reeled tubing.

Toward the fulfillment of these and other objects, the running tool of the present invention is formed by a piston assembly extending over a portion of an inner mandrel assembly and in engagement with a locking device. Shear pins connect the piston assembly relative to the inner mandrel assembly and a fluid chamber is defined by cooperating shoulders formed on the inner mandrel assembly and the piston assembly. The inner mandrel assembly has a bore which can be connected to the fluid chamber for establishing fluid pressure in the fluid chamber to exert oppositely directed forces on the shoulders to shear the shear pins in response to a predetermined value of the fluid pressure to permit axial movement of the piston assembly to actuate the locking device.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1A:
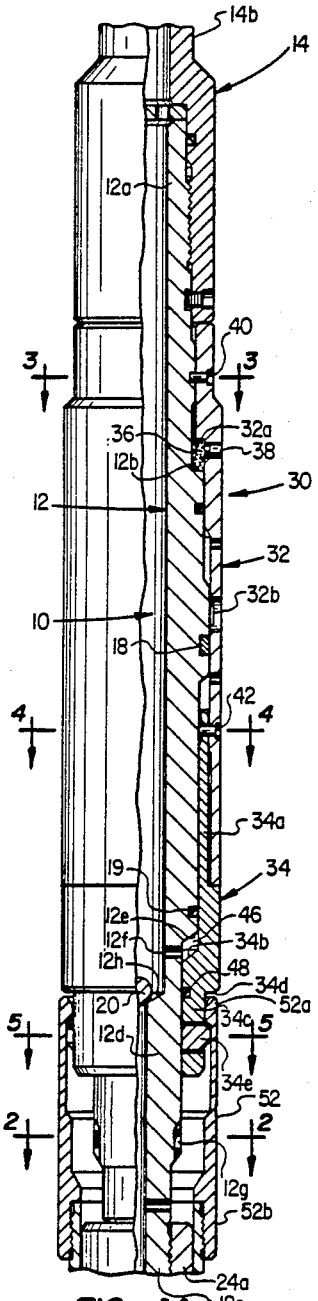
FIGS. 1A and 1B are longitudinal sectional views of the running tool of the present invention, with FIG. 1B being an downward continuation of FIG. 1A.
Figure 1B:
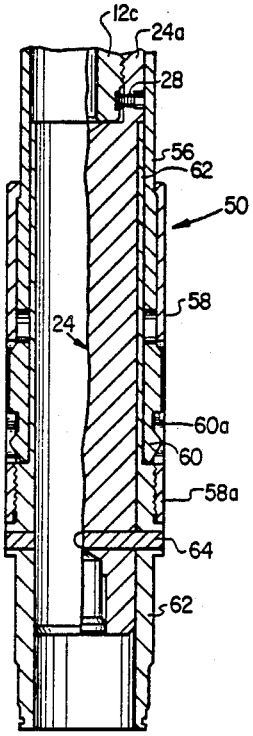

The running tool of the present invention is depicted in FIGS. 1A and 1B of the drawings, and includes an inner mandrel assembly shown, in general, by the reference numeral 10. The assembly 10 includes an inner mandrel 12 having a first reduced diameter portion **12*a* formed at it upper end which defines a shoulder 12*b*. The mandrel portion 12*a* is sized to extend within a correspondingly formed end portion of a crossover 14 which is connected to a string of other components as will be discussed. The outer surface of the mandrel portion 12*a* and the inner bore of the crossover 14** are threaded to enable the mandrel portion to be inserted into the end of the crossover in a telescoping, coaxial relationship and secured thereto in a conventional manner.

Figure 2:
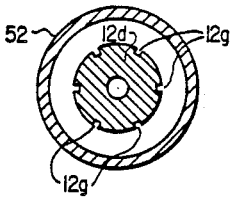

The inner mandrel 12 has a reduced diameter portion **12*c* formed at is lower end and an intermediate reduced diameter portion 12*d* located just above the mandrel portion 12*c* and forming a shoulder 12*e*. Six radially extending passages 12*f*, spaced at 60 degree intervals, extend through the mandrel portion 12*c* just below the shoulder 12*e* and, as shown in FIGS. 1 and 2, six equalizer slots 12*g*, spaced at 60 degree intervals, are formed in the outer surface of the mandrel portion 12*c***.

A snap ring 18 and an O-ring 19 are respectively provided in two grooves formed in the outer surface of the mandrel 12, and the lower end portion of the bore of the mandrel 12 is enlarged to form a shoulder **12*h* for receiving a ball valve 20**.

The functions of the shoulders **12*e* and 12*h*, the passage 12*f*, the slots 12*g*, the snap ring 18, the O-ring 19 and the ball valve 20** will be described later.

The inner mandrel assembly 10 also includes a core 24 connected to its lower end portion. The core 24 has a neck portion **24*a* formed at its upper end which extends over the reduced diameter portion 12*c* of the mandrel 12 and is in threaded engagement therewith. A retaining screw 28 extends through the neck portion 24*a* and into a slot formed in the outer surface of the mandrel portion 12*c*** to secure the latter connection.

A piston assembly 30 extends over the outer surface of the inner mandrel assembly 10 and includes a tubular sub 32 connected to a piston 34. The sub 32 has a stepped internal surface defining a shoulder **32*a* which, in the position of FIG. 1A, is spaced a relatively short distance from the shoulder 12*b* of the mandrel 12 to define a cavity 36. A plug, or a set screw, 38 extends through a radial opening in the sub 32 in communication with the cavity 36** to permit the cavity to be filled with grease for reasons to be explained.

A groove **32*b* is provided in the inner surface of the sub 32 for receiving the snap ring 18** under conditions that will be described.

Figure 3:
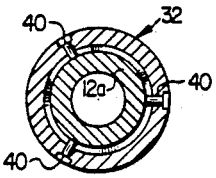

As shown in FIGS. 1A and 3, three circumferentially spaced shear pins 40, angularly spaced at 120 degree intervals, extend through corresponding radial openings in the sub 32 and into a circular slot formed in the outer surface of the mandrel portion **12*a*. The shear pins 40 function to normally restrain axial movement of the piston assembly 30 relative to the mandrel assembly 10**.

Figure 4:
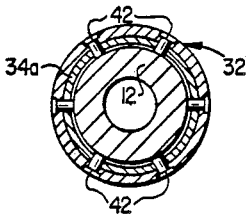
FIGS. 2–5 are traverse sectional views taken along the lines 2—2 through 5—5, respectively, of FIG. 1A.

The upper portion of the piston 34 has a reduced diameter portion **34*a* which receives the lower end portion of the sub 32 in a telescoping relationship. As shown in FIGS. 1A and 4, six circumferentially spaced shear pins 42, spaced at 60 degree intervals, extend through an aligned radial openings in the lower end portion of the sub 32 and the end portion 34*a* of the piston 34 to normally restrain axial movement of the piston relative to the sub. Since the shear pins 40 and 42 are identical, the six shear pins 42 collectively have a greater shear stress capacity than that of the three shear pins 40** so that the latter will shear before the former as will be described.

The inner surface of the piston 34 is stepped as shown to define a shoulder **34*b* which is located in a facing, slightly spaced, relationship to the shoulder 12*e* of the mandrel 12 to define a cavity 46 which registers with the passages 12*f* of the mandrel 12** for reasons to be described.

Figure 5:
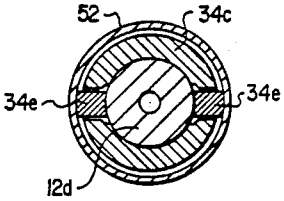

The lower end portion **34*c* of the piston 34 is of a reduced diameter to form a shoulder 34*d* and an O-ring 48 extends in a groove found in the inner surface of the piston. As shown in FIGS. 1A and 5, two lugs 34*e*, angularly spaced 180 degrees, extend through corresponding openings formed in the piston portion 34*c*. The lugs 34*e* are radially movable in the opening between the extended position shown FIGS. 1A and 5** and a retracted position that will be described.

A locking mandrel assembly is shown in general by the reference numeral 50, and includes a fishing neck 52 having an enlarged end portion **52*a* defining an internal shoulder which is normally engaged by the lugs 34*e* of the piston 34. The end of the fishing neck 52 is located in a slightly spaced relationship to the shoulder 34*d* of the piston 34**.

The mandrel assembly 50 also includes an expander sleeve 56 in threaded engagement with the lower end portion **52*b* of the fishing neck 52 in and extending over the core 24 for slidable movement relative thereto. The lower portion of the expander sleeve 56 extends within the upper end portion of a key retainer sleeve 58 also extending over the core 24. Three locking keys 60 (two of which are shown in FIG. 1B) are angularly spaced at 120 degree intervals, and extend in corresponding openings formed in the key retainer sleeve 58, it being understood that three leaf springs (not shown) are provided between the sleeve 58 and the expander sleeve 56. Each leaf spring is bent so that its upper portion extends radially in a slot (not shown) formed in the sleeve 58 and its lower end portion extends underneath a corresponding key 60. The lower end of the sleeve 56 normally engages the bent portions of the leaf springs so that movement of the piston 34, and therefore, the locking mandrel assembly 50, downwardly causes a corresponding slidable movement of the sleeve 56 downwardly and cams the release springs radially outwardly which, in turn, forces the keys 60 radially outwardly into a locking position relative to a landing nipple installed in a wellbore as will be described. Since the locking mandrel assembly 50** and its leaf springs are conventional and are more specifically described in U.S. Pat. No. 3,208,531, assigned to the same assignee as the present invention, they will not be described in any further detail.

The lower end portion **58*a* of the sleeve 58 is threadedly connected to a mandrel 62 adapted to receive another component (not shown) such as a plug, a flow control device, or the like. A shear pin 64 extends through corresponding and aligned radial bores formed in the mandrel 62 and the core 24, respectively, to secure the two components together. Thus, by locking the mandrel assembly 50** relative to a landing nipple in a manner to be described the component connected to the locking mandrel can be located precisely in the wellbore.

The crossover 14 is connected to a string of tools extending above the running tool and depicted in FIG. 6A–6F.

Figure 6A:
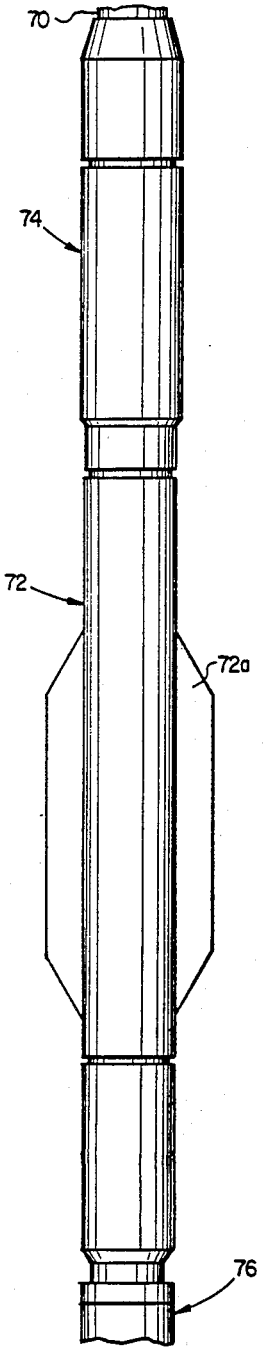
FIGS. 6A–6F are elevational views depicting a series of associated components connected between the end of a section of reeled tubing and the running tool of FIGS. 1–5, with FIG. 6B being a downward continuation of FIG. 6A, FIG. 6C being a downward continuation of FIG. 6B, FIG. 6D being a downward continuation of FIG. 6C, FIG. 6E being a downward continuation of FIG. 6D and FIG. 6F being a downward continuation of FIG. 6E.

More particularly, the lower end portion of a section of reeled tubing shown by the reference numeral 70 in FIG. 6A is connected to one end of a centralizer 72 by an emergency disconnect device 74 which will be described in detail later. The centralizer 72 has an enlarged portion **72*a* which closely corresponds to the inner diameter of the wellbore and thus functions to limit the tilting and bending of the reeled tubing 70** in the wellbore, and thus protect the other components below the centralizer.

One end of a knuckle-joint 76 (FIGS. 6A and 6B) is connected to the other end of the centralizer 72 in order to enable that portion of the assembly extending below the knuckle-joint 76 to bend relatively to that portion extending above the knuckle-joint. Thus the assembly can more easily traverse horizontal or deviated wells.

Figure 6B:
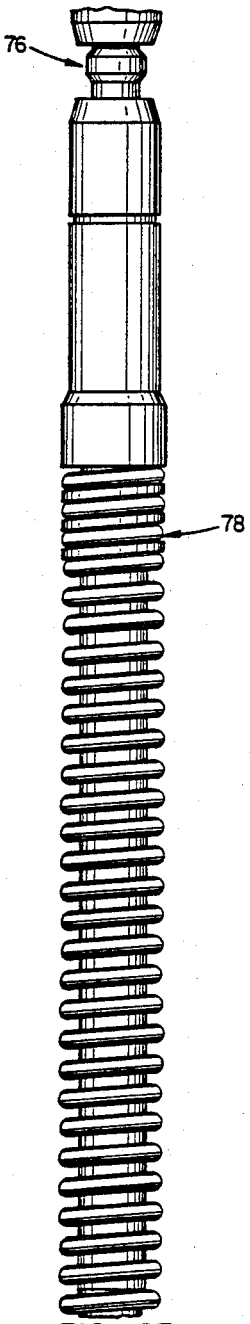
Figure 6C:
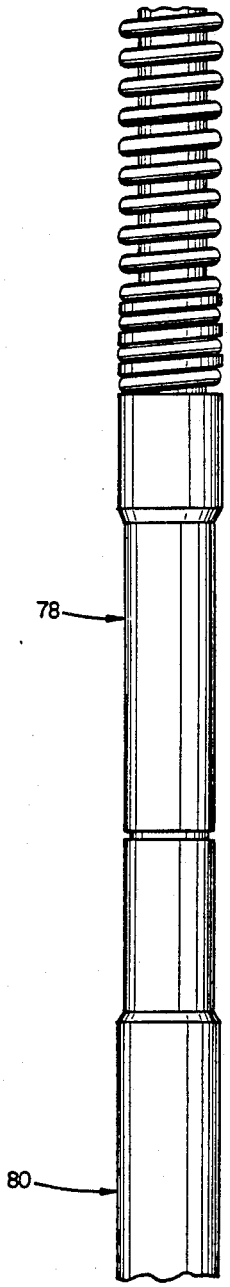

As shown in FIGS. 6B and 6C, the upper end of an accelerator 78 is connected to the lower end of the knuckle-joint 76 and functions to create spring forces to accelerate the running tool of the present invention to create high impact loading in an upwardly direction as will be described. Since the accelerator 78 functions in a conventional manner it will not be described in any further detail.

A weighted stem 80 (FIGS. 6C and 6D) connects the lower end of accelerator 78 to the upper end of a hydraulic jar 82. The stem 80 provides the increased weight and mass necessary to create the high impact loading discussed herein.

Figure 6D:
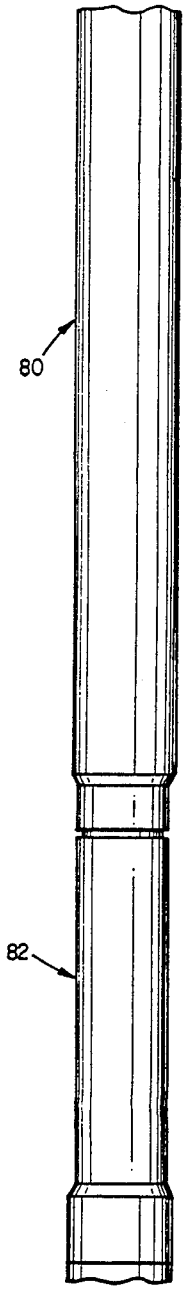
Figure 6E:
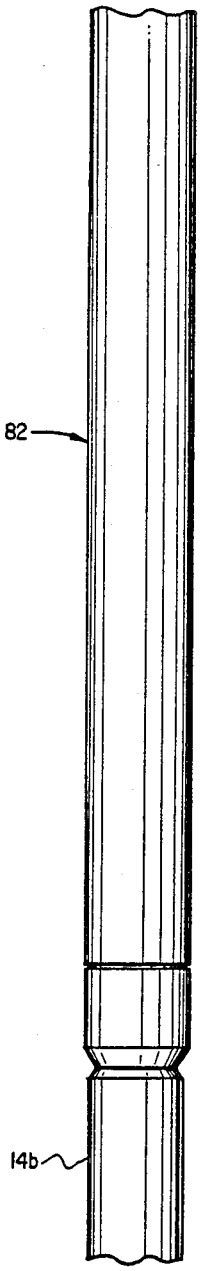
Figure 6F:
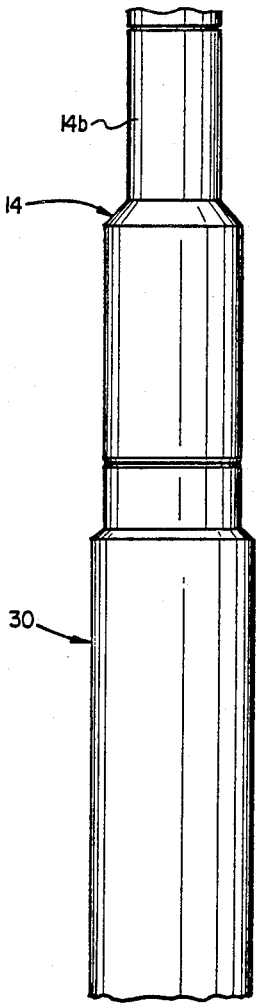

The hydraulic jar 82 is depicted in FIGS. 6D and 6E and functions in cooperation with the accelerator 78 and stem 80 to provide high impact loading in an upwardly direction such as in the manner disclosed in U.S. patent application Ser. No. 269,996 filed Nov. 11, 1988 and assigned to the same assignee as the present invention. The lower end of the hydraulic jar 82 is connected to the upper end portion **14*b* of the crossover 14 of the running tool of the present invention as shown in FIGS. 6F and 1A**.

Figure 7:
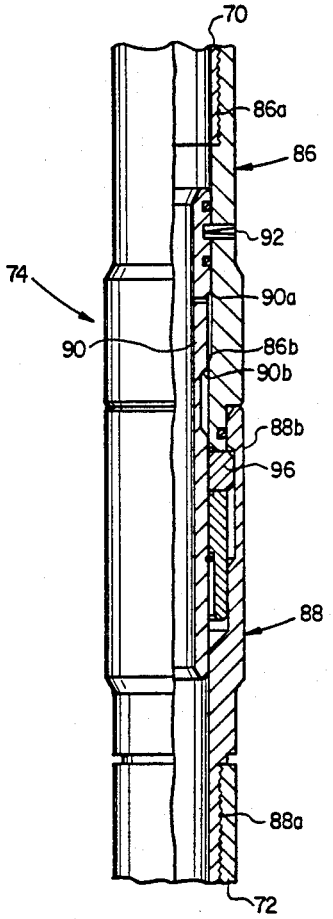
FIG. 7 is a longitudinal sectional view of the emergency disconnect device of FIG. 6A.

The emergency disconnect device 74 which is connected between the reeled tubing 70 and the centralizer 72, is shown in detail in FIG. 7. The disconnect device 74 comprises a top sub 86 having an internally threaded portion **86*a* for connecting to the reeled tubing 70, and a bottom sub 88 having an externally threaded portion 88*a* disposed at one end for connecting to the centralizer 72 and a fishneck 88*b*** at its other end.

The bottom sub 88 is aligned with the top sub 86 in a coaxial relationship and a tubular prop 90 is disposed in the bore defined by the aligned bores of the top sub and the bottom sub in engagement therewith.

A plurality of angularly spaced shear pins 92, one of which is shown in FIG. 7, extend through radially-extending through openings in the top sub 86 and into an aligned groove in the prop 90. Two seal rings **94*a* and 94*b* extend in grooves in the prop 90 formed to either sides of the shear pins 92. The internal bore of the top sub 86 and the external surface of the prop are stepped to form two spaced shoulders 86*b* and 90*a*, respectively, and an enlarged groove 90*b* is formed in the outer surface of the prop 90 just below the shoulder 86*b***.

Two lugs 96, one of which is shown in FIG. 7, are provided through corresponding openings in the top sub 86 and are angularly spaced 180 degrees. One end of each lug 96 extends flush with the bore of the top sub 86 and the other end portion projects outwardly from its opening in engagement with the internal shoulder of the fishneck **88*b* of the bottom sub 88** to retain the bottom sub in the position shown.

In the event it is desired to activate the device 74 when, for example, any of the tools previously described become jammed in the wellbore, a ball (not shown) of a diameter slightly less than the bore of the top sub 86 can be pumped through the reeled tubing 70 and into the top sub where it engages the upper end of the prop 90. This seals off the prop 90, allows pressure to build up above the ball and forces the prop downwardly until the pins 92 shear. This, in turn, allows the prop 90 to move downwardly relative to the top sub 86 and the bottom sub 88 until the shoulder **90*a* engages the shoulder 86*b*. In this position, the groove 90*b* aligns with the lugs 94 which allows the lugs to move into the groove and release from the fishneck 88*b***.

The reeled tubing 70 can then be pulled out of wellbore, taking the top sub 86 and the prop 90 with it and leaving the bottom sub 88 including the exposed fishneck **88*b*. A pulling tool, or the like, could then be dropped into the wellbore to engage the fishneck 88*b*** for the purpose of releasing the jammed tool.

It is understood that each of the components shown in the string of FIGS. 6A–6F, and discussed above, have a through bore for the flow of fluid therethrough so that fluid introduced into the reeled tubing 70 above ground flows through the tubing, the components of FIGS. 6A–6F, including the running tool of the present invention. Otherwise all of the above described connections between the various components of FIGS. 6A–6F can be conventional and, as such, would normally consist of a male and female tubular portions in threaded engagement. Since these connections are conventional they will not be described in any further detail.

In operation, the crossover 14 of the running tool of the present invention is connected to the lower end of the string of components depicted in FIGS. 6A–6E and the locking mandrel assembly 50 is connected between the lower end of the running tool and an operating tool such as a flow control device or the like (not shown) for securing in the wellbore. The running tool is placed in the mode shown in FIGS. 1A and 1B, i.e. with the shear pins 40 and 42 in place, with the locking lugs **34*e* engaging the corresponding end of the fishing neck 52 of the locking mandrel assembly 50, and with the ball valve 20 in the bore of the inner mandrel 12. The entire assembly is then lowered into the wellbore until the pressurized fluid in the well enters the lower end of the bore of the running tool and lifts the valve 20 off the shoulder 12*h* thus permitting the well fluid to pass through the components of FIGS. 6A–6F and into the reeled tubing 70. This enables the reeled tubing to fill which balances the pressure across the wall of the tubing. Since the keys 60 are in their retracted position of FIG. 1B during this movement, neither the locking mandrel assembly 50** nor the running tool drags in any substantial manner against the wall of the wellbore.

Figure 8A:
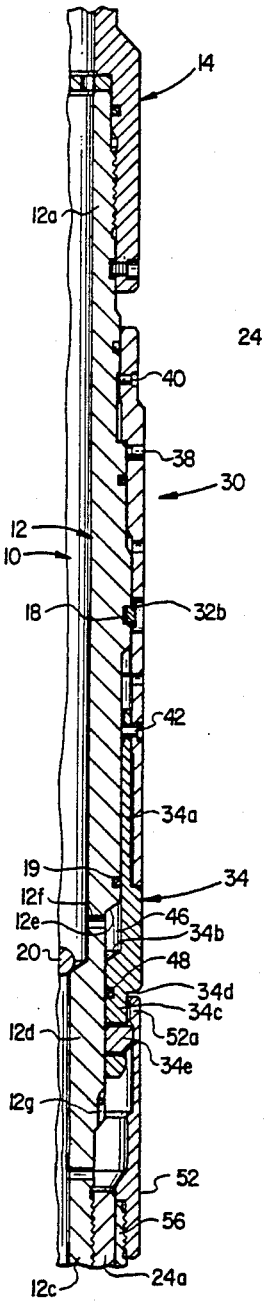
FIGS. 8A and 8B are views similar to FIGS. 1A and 1B, respectively, but showing the latching operation of the running tool of the present invention.
Figure 8B:
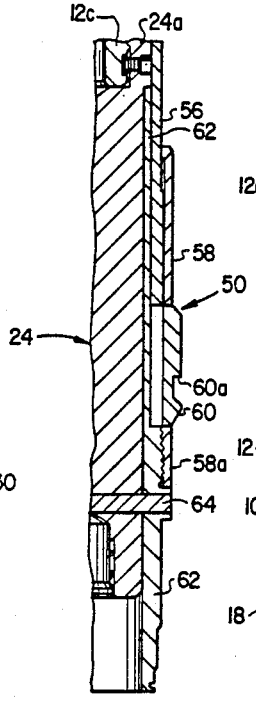

The assembly is lowered a sufficient distance in the wellbore, as determined by a counter or the like which is monitored by the operator, until the locking mandrel assembly 50 moves just above a landing nipple (not shown) in the wellbore with respect to which it is desired to position and locking mandrel assembly 50. Fluid under relatively high pressure is then introduced into the reeled tubing 70 and passes through the centralizer 72, the knuckle-joint 76, the accelerator 78, the stem 80, the hydraulic jar 82, before entering the crossover 14 of the running tool and, passing to the inner mandrel 12. This flow of fluid forces the ball valve 20 against the shoulder **12*h* and diverts the fluid flow into the cavity 46 formed between the inner mandrel 12 and the piston 34. The O-rings 19 and 48, acting on the surfaces of the piston 34 and the inner mandrel 12, respectively, seal against leakage of fluid from the cavity 46 so that the fluid pressure in the cavity exerts oppositely directed forces against the shoulders 12*e* and 34*b*, respectively. When these forces have attained a predetermined value, the three shear pins 40 connecting the sub 32 to the inner mandrel 12 shear. This causes downward axial movement of the piston assembly 30 relative to the inner mandrel assembly 10 to the position shown in FIGS. 8A and 8B, i.e. until the shoulder 32*a* of the sub 32 contacts the facing shoulder 12*b* of the mandrel 12 and the snap ring 18 snaps into the groove 32*b*, thus preventing any further relative movement between the piston assembly 30 and the mandrel assembly 10. It is noted that this latter movement is dampened by the grease in the cavity 36 to prevent undesirable shear stresses on the assembly. This downward axial movement of the piston assembly 30 causes the shoulder 34*d* of the piston 34 to push, or force, the enlarged portion 52*a* of the fishing neck 52 to of the locking mandrel assembly 50 downwardly and thus causes the expander sleeve 56 to force the leaf springs (not shown) and therefore the locking keys 60 radially outwardly to this "seeking" position shown in FIG. 8B**.

With the keys 60 thus biased outwardly, the entire assembly is moved downwardly a short distance by corresponding actuation of the reeled tubing 70 so that the keys 60 will ride along the wall of the bore of the landing nipple which has a restricted diameter which retracts the keys 60 against the bias of the leaf springs. This downward movement continues until the keys 60 align with a locking groove formed in the landing nipple which has a profile corresponding to that of the keys 60. At this time the keys 60 are biased into this profile under the action of the leaf springs so that the shoulders **60*a* of the keys 60 engage a corresponding shoulder forming the corresponding profile of the landing nipple. This locks the locking mandrel assembly 50** relative to the landing nipple and prevents further movement of the mandrel.

Figure 9A:
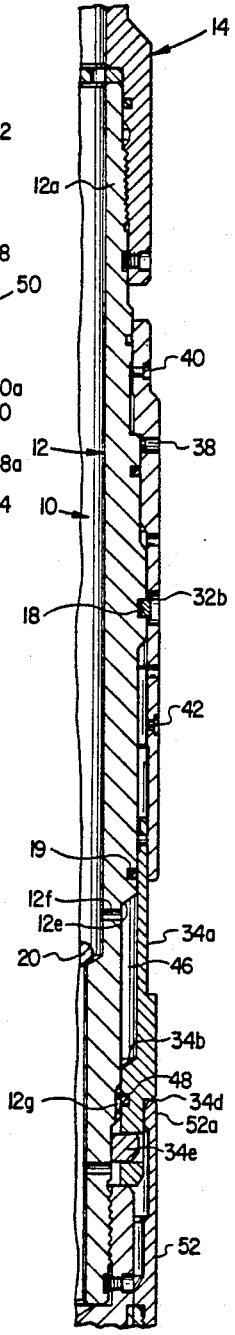
FIGS. 9A and 9B are views similar to FIG. 1A and 1B, respectively, but showing the position of the running tool of the present invention after the latching operation is completed.
Figure 9B:
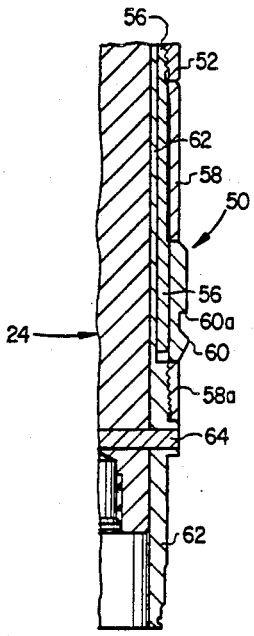

Additional fluid is then pumped into the bore of the inner mandrel 12 and passes through the passages **12*f* into the cavity 46 to increase the shear stress on the pins 42 until they shear and thus permit downward movement of the piston 34 relative to sub 32 and the locking mandrel assembly 50. The shoulder 34*d* of the piston pushes or forces the facing end portion of the fishing neck 52 of the locking mandrel assembly 50 further downwardly to cause corresponding downward movement of the expander sleeve 56 to the position of FIGS. 9A and 9B, i.e. underneath the keys 60 to secure them in this expanded locking position. This positively locks the keys 60 in the profile of the locking nipple and thus secures the locking mandrel assembly 50 and therefore the operating tool relative to the locking nipple. It is noted that, in the position of FIG. 9A, the lugs 34*e* have moved over the reduced diameter mandrel portion 12*c* and thus release their engagement from the fishing neck 52 of the locking mandrel assembly 50. Also, the O-ring 48 extends over the equalizer slots 12*g* to permit flow from the cavity 46 to relieve the pressure therein which signals the operator that the locking operation has been completed. This flow from the cavity can pass, through appropriate openings (not shown) found in the fishing neck 52**, to the wellbore.

In the event it is desired to disengage the running tool from the locking mandrel assembly 50 in order to enable the running tool to be removed from the wellbore, an upwardly exerted force can be applied to the running tool via the reeled tubing 70 and the associated components until the shear pin 64 shears, thus releasing the core 24 from the mandrel 62 and therefore the mandrel assembly 50. Since the lugs **34*e* are no longer engaging the fishing neck 52 of the locking mandrel, the running tool can be removed from the wellbore with the locking mandrel assembly 50** locked in place relative to the landing nipple.

It is thus seen that there are several advantages to the running tool of the present invention. For example, it enables the locking mandrel assembly 50 to be actuated relatively easily with a minimum of moving parts. The running tool is also operable with reeled tubing and as such can be inserted into a horizontal or deviated wellbore. The running tool also actuates the locking mandrel by the introduction of fluid pressure, a relatively simple technique when compared to the techniques required in connection with wire line running tools. Further the movement of the ball valve off the shoulder **12*h*** by the well fluid during insertion of the running tool into the wellbore insures that the reeled tubing will fill with the well fluid and balance the pressure across its wall, thus preventing the wall from collapsing under the pressure of the well fluid between the outer surface of the reeled tubing and the bore of the well.

It is understood that several variations may be made in the running tool of the present invention without departing from the scope of the invention. For example, the specific construction and arrangement of the associated components, including the locking mandrel 50, can be varied within the scope of the invention. Also, the running tool of the present invention can be modified within the scope of the invention to connect to locking mandrels having outside fishing necks rather than the inside fishing necks 52 as shown in the drawings. Further the emergency disconnect device 74 can be connected between any of the components depicted in FIGS. 6A–6E other than between the reeled tubing 70 and the centralizer 72.

Other modifications, changes and substitutions is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A running tool for connection relative to reeled tubing for actuating a tubular locking device in a wellbore, said running tool comprising:

(a) a mandrel assembly defining a bore and adapted for connection to an end section of said reeled tubing for introducing fluid into said bore;

(b) piston means extending over a portion of said mandrel assembly in engagement with said locking device;

(c) connecting means connecting said piston means relative to said mandrel assembly;

(d) cooperating shoulders formed on said mandrel assembly and said piston means for defining a fluid chamber; and (e) passage means connecting said mandrel assembly bore to said fluid chamber for establishing fluid pressure in said fluid chamber to exert oppositely directed forces on said shoulders, respectively;

(f) said connecting means being constructed and arranged to respond to a predetermined fluid pressure in said fluid chamber to release said connection between said piston means and said mandrel assembly and permit axial movement of said piston means relative to said mandrel assembly to actuate said locking device.

2. The running tool of claim 1 wherein said fluid normally flows through the entire bore of said mandrel assembly and further comprising valve means disposed in said bore for diverting said flow through said passage means to said fluid chamber.

3. The running tool of claim 1 wherein said piston means comprises a tubular housing, a piston for engaging said locking device and additional connecting means for connecting said tubular housing to said piston, said additional connecting means being constructed and arranged to respond to another predetermined fluid pressure in said chamber to release said connection between said tubular housing and said piston for permitting further axial movement of said piston to lock said locking device in said actuated position.

4. The running tool of claim 3 wherein said piston includes at least one retaining lug normally engaging said locking device to prevent movement of a portion of said locking device relative to the remaining portion of said locking device, said mandrel assembly having a reduced diameter portion over which said piston moves during said further axial movement thereof to release said engagement of said retaining lug with said portion of said locking device and permit said running tool to be removed from said well bore.

5. The running tool of claim 1 wherein said connecting means and said additional connecting means each comprises a plurality of shear pins, the shear pins forming said additional connecting means being adapted to shear in response to a greater fluid pressure in said fluid chamber than the shear pins forming said connecting means.

6. The running tool of claim 1 further comprising means connecting said mandrel assembly to said locking device, said latter connecting means being constructed and arranged to respond to a predetermined upwardly pulling force on said mandrel assembly, via said reeled tubing, to release said connection between said mandrel assembly and said locking device and enable said running tool to be removed from said well bore.

7. The running tool of claim 1 further comprising means responsive to a predetermined amount of said axial movement of said piston means for locking said piston means relative to said mandrel assembly.

8. The running tool of claim 7 wherein said locking means comprises a snap ring disposed on said mandrel assembly and adapted to extend into a corresponding groove in said piston means to retain said mandrel assembly relative to said piston means after said predetermined amount of said axial movement.

9. The running tool of claim 1 further comprising means responsive to a predetermined amount of said axial movement of said piston means for relieving said fluid pressure.

10. The running tool of claim 1 wherein said fluid normally passes through said bore and bypasses said fluid chamber, and further comprising valve means disposed in said mandrel assembly for diverting said fluid flow from said bore to said fluid chamber.

11. A running tool for connection relative to reeled tubing for actuating a tubular locking device in a wellbore, said tubular locking device having radially expandable lock keys for engaging a cooperating surface in said well bore, said running tool comprising:

(a) an inner mandrel assembly defining a bore and comprising:
  (1) an inner mandrel;
  (2) a core; and
  (3) means securing said inner mandrel relative to said core to prevent relative axial movement therebetween;
(b) means connecting said inner mandrel assembly to an end section of said reeled tubing for introducing fluid into said bore;
(c) a piston assembly extending over a portion of said inner mandrel assembly and comprising:
  (1) a tubular housing;
  (2) a piston for engaging said locking device; and
  (3) first shear means connecting said piston relative to said inner mandrel assembly;
(d) second shear means connecting said piston assembly relative to said inner mandrel assembly;
(e) cooperating shoulders formed on said inner mandrel assembly and said piston assembly for defining a fluid chamber; and
(f) passage means connecting said inner mandrel assembly bore to said fluid chamber for establishing fluid pressure in said fluid chamber to exert oppositely directed forces on said shoulders, respectively;
(g) said first shear means being constructed and arranged to respond to a predetermined fluid pressure in said fluid chamber to release said connection between said piston assembly and said inner mandrel assembly and permit axial movement of said piston assembly relative to said mandrel assembly and corresponding movement of said locking device to expand said lock keys to a locking position;
(h) said second shear means being constructed and arranged to respond to another predetermined fluid pressure in said fluid chamber to release said connection between said tubular housing and said piston for permitting further axial movement of said piston and corresponding movement of a portion of said locking device to lock said lock keys in said expanded position.

12. The running tool of claim 11 wherein said fluid normally flows through the entire bore of said inner mandrel assembly and further comprising valve means disposed in said bore for diverting said flow through said passage means to said fluid chamber.

13. The running tool of claim 11 further comprising third shear means securing said core to said locking device, said third shear means being constructed and arranged to respond to a predetermined upward pulling force or said core, via said inner mandrel and said reeled tubing, to release said connection between said core and said locking device and enable said running tool to be removed from said well bore.

14. The running tool of claim 11 wherein said piston includes at least one retaining lug normally engaging said locking device to prevent movement of a portion of said locking device relative to the remaining portion of said locking device, said inner mandrel having a reduced diameter portion over which said piston moves during said further axial movement thereof to release said engagement of said retaining lug with said portion of said locking device and permit said running tool to be removed from said well bore.

15. The running tool of claim 11 further comprising means responsive to a predetermined amount of said axial movement of said piston assembly for locking said piston assembly relative to said inner mandrel assembly.

16. The running tool of claim 15 wherein said locking means comprises a snap ring disposed on said inner mandrel and adapted to extend into a corresponding groove in said piston after said predetermined amount of said axial movement.

17. The running tool of claim 11 further comprising means responsive to a predetermined amount of said axial movement of said piston for relieving said fluid pressure.

18. The running tool of claim 11 wherein said fluid normally passes through said bore and bypasses said fluid chamber, and further comprising valve means disposed in said mandrel assembly for diverting said fluid flow from said bore to said fluid chamber.

19. A running tool for actuating a locking device in a wellbore comprising:

(a) a mandrel assembly having a bore and a cavity registering with said bore;

(b) means connecting one end portion of said mandrel assembly to a reeled tubing for introducing fluid to said bore;

(c) means for connecting the other end position of said mandrel assembly to said locking device; and (d) means for selectively directing said fluid from said bore to said cavity;

(e) said mandrel assembly comprising a first portion and a second portion moveable axially relative to said first portion in response to a predetermined fluid pressure in said cavity to actuate said locking device.

20. A method of actuating a locking device in a wellbore comprising the steps of:

(a) introducing fluid to a bore of a mandrel assembly connected to said locking device; and (b) selectively directing said fluid from said bore to a cavity formed in said mandrel assembly and registering with said bore;

(c) said mandrel assembly adapted to respond to a first and second predetermined fluid pressure in said cavity for expanding a key assembly associated with said locking device and locking said key assembly in said expanded condition, respectively.

21. The method of claim 20 wherein said mandrel assembly is adapted to expand axially in response to said first predetermined fluid pressure in said cavity to actuate said locking device.

22. A running tool for actuating a locking device in a wellbore comprising:

(a) a mandrel assembly having a bore and a cavity registering with said bore;

(b) means connecting one end portion of said mandrel assembly to a reeled tubing for introducing fluid to said bore;

(c) means for connecting the other end portion of said mandrel assembly to said locking device; and (d) means for selectively directing said fluid from said bore to said cavity;

(e) said mandrel assembly adapted to respond to a first and second predetermined fluid pressure in said cavity for expanding a locking key assembly associated with said locking device and locking said locking key assembly in said expanded condition, respectively.

* * * * *

UNITED STATES PATENT AND TRADEMARK OFFICE

CERTIFICATE OF CORRECTION

PATENT NO. : 4,986,362

DATED : January 22, 1991

INVENTOR(S) : Charles W. Pleasants

It is certified that error appears in the above-identified patent and that said Letters Patent is hereby corrected as shown below:

On the title page: Insert item (73);

-- Assignee: Otis Engineering Corporation --

Signed and Sealed this

First Day of September, 1992

*Attest:*

DOUGLAS B. COMER

*Attesting Officer*

*Acting Commissioner of Patents and Trademarks*